United States Patent [19]

Beck

[11] 4,454,815

[45] Jun. 19, 1984

[54] REPROGRAMMABLE ELECTRONIC FUZE

[75] Inventor: Peter M. Beck, Denville, N.J.

[73] Assignee: The United States of America as represented by the Secretary of the Army, Washington, D.C.

[21] Appl. No.: 303,814

[22] Filed: Sep. 21, 1981

[51] Int. Cl.[3] ..... F42C 17/00

[52] U.S. Cl. ..... 102/206; 89/6.5; 102/215

[58] Field of Search ..... 102/206, 270, 215; 89/6, 6.5

[56] References Cited

U.S. PATENT DOCUMENTS

| | | | |
|---|---|---|---|
| 3,976,012 | 8/1976 | Nordgren | 102/270 |
| 4,022,102 | 5/1977 | Ettel | 89/6.5 |
| 4,160,416 | 7/1979 | Baracz | 102/215 |
| 4,237,789 | 12/1980 | Stauers et al. | 102/206 |

*Primary Examiner*—Charles T. Jordan

*Attorney, Agent, or Firm*—Robert P. Gibson; Anthony T. Lane; Max Yarmovsky

[57] ABSTRACT

The invention is an improved process for programming electronic fuzes, whereby the fuze facility may be reprogrammed electronically without the need for disassembly and replacement of components of the circuitry. The invention comprises a circuit arrangement which provides a secondary receiving coil, of the reprogrammable electronic fuze system, that is positioned adjacent to the interior surface of a munition wall so that it can easily pick up high frequency programming signals from an external drive circuit. The receiving coil feeds programming signals to a rectifier. The output of the rectifier encodes a bubble memory. The bubble memory can be reprogrammed anytime prior to the use of the munition, by the same procedure. When the munition is deployed a launching mechanism closes an activation switch to the munitions power supply and at the same moment a short high frequency arming pulse from the external signal activates the internal power supply. This arming pulse causes no significant effect on the programming circuitry. Thereafter, the circuitry provides for processing the program in the bubble memory through sensing circuitry and a microcomputer to make various fuzing decisions.

4 Claims, 3 Drawing Figures

REPROGRAMMABLE ELECTRONIC FUZE

GOVERNMENTAL INTEREST

The invention described herein may be manufactured, used and licensed by or for the Government for Government purposes without the payment to me of any royalties.

BACKGROUND OF THE INVENTION

The invention relates to fuzing means, and in particular to electronic fuzing means for munitions. Specifically, the invention relates to an electronic fuzing means for munitions that can be reprogrammed without disassembly of the munitions to replace parts that would be destroyed by programming methods of the prior art.

In the prior art various means have been used to arm a munition during the launching or deployment operation. Such arming means, however, involved the destruction of internal parts, or otherwise causing internal changes, that required disassembly of the unit to replace the parts if it had to be reprogrammed. Several of the problems in the prior art are discussed hereinafter. In general, there are two methods in the prior art of electrically programming a non-volatile memory of munition fuzes. The first method burns out a fuseable link providing non-alterable single bit data storage. The second method requires energy on the memory element while it is being altered (programmed).

One of the means of the prior art for arming a munition electrically was to induce a short high frequency pulse by electromagnetic coupling into the munition's internal arming circuitry. Usually, the high frequency pulse had to have sufficient energy to burn out fuseable wire links (which then programmed) and actuated the munition. Frequently, the programming was accomplished by controlling the amplitude of the high frequency pulse. However, due to the limited resolution of such systems the number of instructions were limited to only two.

Another problem with some of the prior art arming devices was that they frequently attempted to combine the programming and the activation operations during the launch period. The combined operations during launch limited the time available to deliver programming instructions and usually prevented any last minute change in setting.

Still another problem in the prior art devices was that the energy transferred by electro-magnetic coupling could not be delivered accurately, because of varying mechanical tolerances and differences in the properties of the magnetic materials surrounding and bridging the inductive working gap.

Yet another problem with the prior art devices using wire links for fuzing was the fact that the link burn out action follows an exponential curve requiring precisely defined amounts of energy to be delivered to the links for consistent results.

The combination of limited time for programming variations in mechanical tolerances and magnetic properties, and the need for precisely defined amounts of energy tended to produce an arming system during launch which was unreliable.

U.S. Pat. No. 4,160,416 details a programmed self-destruct system to solve the aforementioned problems, however, the system is cumbersome and introduces other problems. The resulting problems are because the system utilizes memory devices that require power to be programmed. This requires the programming process to be a two-pass process: the first to power up a capacitor to act as a battery; and the second to transmit data. This adds great complexity to the munitions circuitry where space is a premium. In addition, bubble memories have a far greater ability and are more insensitive to external stimuli than other forms of electronic data storage.

Regarding the aforementioned United States Patent, of the prior art, it is further to be noted that the bubble memory of the present invention is not substitutable in the aforementioned patent, nor is it an obvious matter to one skilled in the art of munition fuzing or to one in utilizing bubble memories. The field is relatively new and new technologies for bubble memories are being developed that are not mere obvious substitutions.

Bubble memories require signals with a relatively high peak current not normally available in electronic circuitry. Therefore, bubble memories are sold as systems that include (for the purpose of making their presence transparent to the user) a "current pulse driver" and a "coil predriver" and "drive transistors" to develop the required currents. In addition, bubble memories are typically used as mass memory devices. When used in this way speed of writing and reading data is of primary importance. This dictates the design of the bubble memory device as well as the ancillary system components. Standard bubble memory devices are typically encoded in an active state to reduce the required number of package pins and time required for encoding. These constraints are not applicable to the fuzing problem, thus opening up a new application area for bubble memories.

SUMMARY OF THE INVENTION

The present invention eliminates the aforementioned problems by providing the ability to have a non-volatile, electrically alterable, energy passive programming element for munition fuzing. The present invention as a solution to the problem is infinitely alterable with no energy required for the memory unit other than the programming signal. In addition, the present method or programming by this invention is non-volatile, low energy, high capacity, and easily testable in assembled fuzes.

In the present invention an external drive circuit provides high frequency signals. The external drive circuit has a power supply with a current limiting resistor and an energy storing capacitor to provide energy to a primary transmitting coil when a send switch is closed.

In the munition assembly, a secondary receiving coil, of the reprogrammable electronic fuze system, is located and positioned adjacent to an interior surface of a munition wall. In this position the secondary receiving coil can easily pick up high frequency signals from the aforementioned external driver circuit. Signals induced into the secondary receiving coil prior to launch are the programming signals. The output of the receiving coil is fed first into a rectifier and second to an activation switch that leads to the munition power supply.

The output from the rectifier provides a write signal to a bubble memory to encode the bubble memory. The bubble memory requires no power to either be programmed or to maintain the data input by the above sequence of events. The bubble memory can be reprogrammed at anytime, prior to the munition being used, by following the same procedure as aforementioned.

Prior to launch of the munition, the bubble memory is encoded as aforementioned.

Upon deployment, a munition activation switch is closed by a launching mechanism which permits a short high frequency arming pulse from the external driver circuit to activate an internal power supply. The output of the internal power supply is electrically connected to a bubble memory sensing circuit and to the munition's microcomputer. The sensing circuit, after the power up action, reads the data previously encoded in the bubble memory by a read loop and a reference loop. After being powered up the microcomputer reads the data contained in the sensing circuitry.

Regarding the aforementioned arming pulse, the arming pulse causes no significant effect upon the programming circuitry, however, it is sufficient to activate an electro-explosive device, which activates the internal power supply (a battery-like means). It is to be noted that the electro-explosive device may also be referred to as a "squib".

Thus, the electronic fuze of this invention now contains in its microcomputer the data transferred from the bubble memory through the sensing circuitry. This data is used to program the microcomputer to process information from other sensors and make various fuzing decisions.

Thus, the present invention is a system for electromagnetically programming an electronic fuze of an energy passive munition prior to deployment.

It is, therefore, an object of the invention to provide a munition with a capability of being easily programmed and being reused in case of a change of task or abandonment of a mission.

It is another object of the invention to provide a programmed fuze for field customizing of fuzing decisions on an energy passive munition where there are no restrictions as to the time or location of the prelaunch programming operation.

It is also an object of the invention to provide an energy passive munition with an encoding system which can be electro-magnetically preprogrammed with a plurality of instructions.

It is still another object of the invention to provide an energy passive munition with electro-magnetic programming prior to launch wherein dimensional tolerances between a transmitter primary coil and the secondary receiver coil are not critical in order to attain reliability.

It is yet another object of the invention to provide an energy passive munition with an electro-magnetically programmed capability prior to launch which is relatively immune to electronic countermeasures.

Further objects and advantages of the invention will become more apparent in the light of the following description of the preferred embodiments.

DESCRIPTION OF THE PREFERRED EMBODIMENTS

Figure 1:
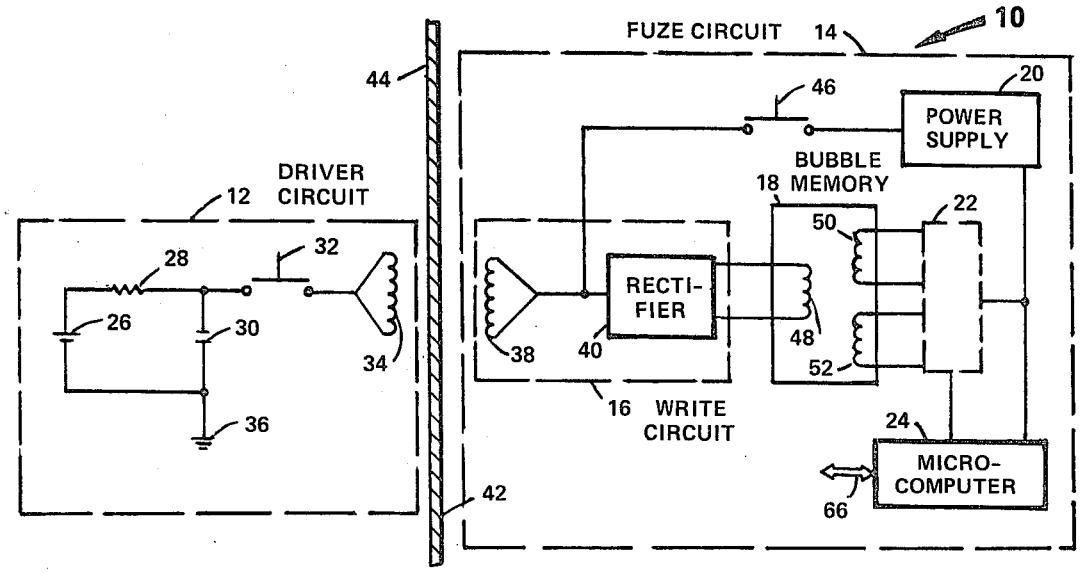
FIG. 1 is a schematic wiring diagram of a reprogammable electronic fuze.

Referring to the drawings, and particularly to FIG. 1, a reprogrammable electronic fuze is shown at 10. The reprogrammable electronic fuze 10 is structured in two distinct segments, an external driver circuit 12, and an internal fuze circuit 14. The internal fuze circuit 14 comprises a write circuit 16, a bubble memory 18, an internal power supply 20, a sensing circuit 22, and a microcomputer 24.

The external driver circuit 12 is external to and separate from the munition carrying the internal fuze circuit 14. The external driver circuit comprises a driver circuit power supply 26, usually a battery, a current limiting resistor 28 electrically coupled in series with power supply 26 and an energy storing capacitor 30 connected in parallel, "send" switch 32 is coupled to an ungrounded capacitor terminal, and a primary transmitting coil 34 is coupled to the switch 32.

The energy storing capacitor 30 provides energy to the primary transmitting coil 34 when the "send" switch 32 is closed. As shown in the wiring diagram the aforementioned components of the external driver circuit 12 are electrically connected together in the manner shown by electrical conductors, not numbered, as follows: one terminal of the driver circuit power supply 26 is connected to a ground means 36, and to the energy storing capacitor 30; the other battery terminal is connected to the current limiting resistor 28; the current limiting resistor 28 and the energy storing capacitor 30 are then connected to one terminal of the "send" switch 32; the other terminal of the send switch is connected to the primary transmitting coil 34.

Turning next to the write circuit 16 of the internal fuze circuit 14, the write circuit 16 comprises a secondary receiving coil 38, and a rectifier 40. The secondary receiving coil 38 is proximately located and positioned adjacent to an interior surface 42 of a munition wall 44. This positioning of the secondary receiving coil 38 at the interior surface 42 of a munition wall 44, is arranged so that the secondary receiving coil 38 can easily pick up high frequency signals from the primary transmitting coil 34 of the external driver circuit 12. Such signals induced in the secondary receiving coil 38 prior to launch are the programming signals. The output of the secondary receiving coil 38 is transmitted simultaneously into the rectifier 40 and to the activation switch 46 of the internal power supply 20.

Figure 2:
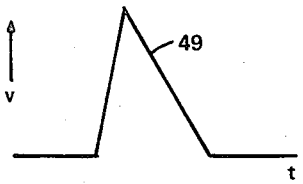
FIG. 2 is a schematic drawing of the write signal from a rectifier to a bubble memory of the wiring diagram of FIG. 1.

The components of the write circuit 16 are also electrically connected together as shown in the wiring diagram by electrical conductors, not numbered, as follows: The secondary receiving coil is connected to the rectifier and to one terminal of the activation switch 46. The output of the rectifier 40 is transmitted to a write loop 48 in the bubble memory 18. This transmission is by electrical conductors as shown in the wiring diagram. The output of the rectifier 40 provides the write signal 49, as shown in FIG. 2, to the write loop 48 which encodes the bubble memory. In FIG. 2 the amplitude of the voltage is shown as along the "v" axis and the time as along the "t" axis.

The bubble memory 18 requires no power to be either programmed or to maintain the data input by the aforementioned sequency of events. The bubble memory 18 can be reprogrammed at anytime prior to the munition being used by following the same procedure as outlined hereinbefore. In operation, prior to launch, the bubble memory 18 of the munition is encoded as described hereinbefore.

Upon deployment the activation switch 46, of the internal power supply 20, is closed by a launching mechanism, not shown, thus permitting a short high frequency arming pulse from the external signal to activate the internal power supply 20 via an electrical conductor, not numbered, from the other terminal of the activation switch 46 to the internal power supply 20 activation means. This activation means for the activation of the internal power supply 20 may be effected such as by an electro-explosive device shattering a battery ampule to release an electrolyte into empty battery cells. The aforementioned arming pulse causes no significant effect on the programming circuitry, but is sufficient to activate the electro-explosive device, also referred to as a "squib", to initiate the internal power supply 20.

The output of the internal power supply 20 is electrically connected to the bubble memory 18 sensing circuit 22 by an electrical conductor, not numbered, as shown in the wiring diagram. The output of the internal power supply 20 is also electrically connected to the munition microcomputer 24 by an electrical conductor, not numbered, as shown in the wiring diagram.

Figure 3:
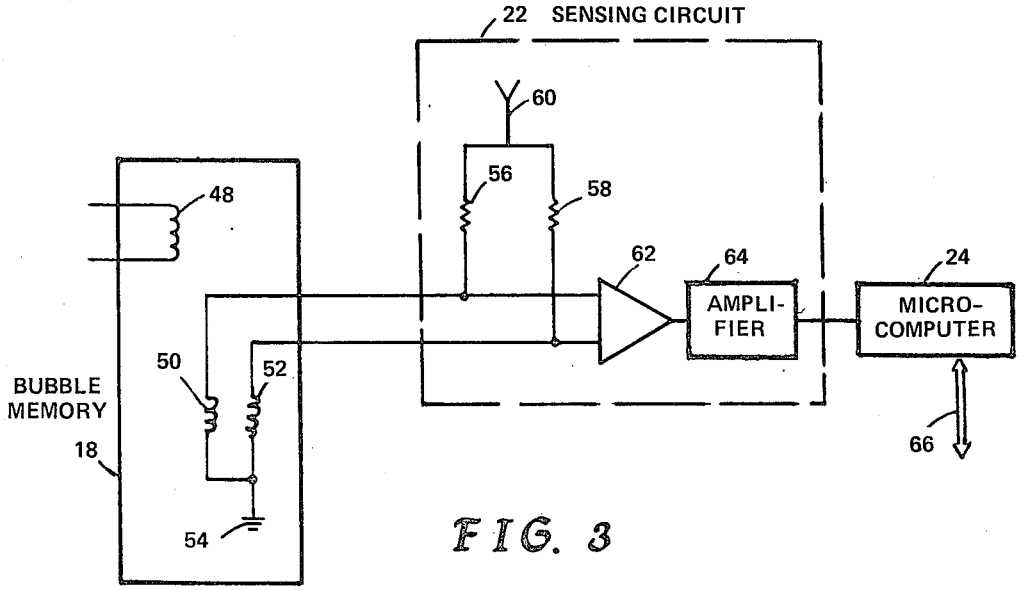
FIG. 3 is a detailed wiring diagram of the sensing circuit of FIG. 1.

A detailed wiring diagram of the sensing circuit 22 is shown in FIG. 3. After the power from the internal power source 20 has been applied to the sensing circuit 22, the sensing circuit 22 reads the data previously encoded in the bubble memory 18. The sensing circuit 22 reads the aforementioned data in the bubble memeory 18 via a read loop 50 and a reference loop 52. The read loop 50 and the reference loop 52 of the sensing circuit 22 extend into the bubble memory 18 and are electrically connected to the sensing circuit 22 by electrical conductors, not numbered, as shown in the wiring diagram in FIG. 1 and FIG. 3.

The sensing circuit 22, the read loop 50 and the reference loop 52 are electrically connected to a ground means 54. The circuitry through the read loop 50 and the reference loop 52 is cross connected through bridge elements 56 and 58 for the memory read signal 60 as shown in FIG. 3. Thereafter the signal passes through a differential amplifier 62 and a sensing amplifier 64 in the sensing circuit 22. As noted these electronic elements or units of the sensing circuit 22 are electrically connected, as shown in the wiring diagram of FIG. 3, by electrical conductors, not numbered.

As power from the internal power source 20 is applied to the munition microcomputer 24 at the same time the power is applied to the sensing circuit 22, the microcomputer 24 reads the data contained in or picked up by the sensing circuit 22. This is accomplished through electrical connection of the microcomputer 24 to the sensing circuit 22 by an electrical conductor, not numbered, as shown in the wiring diagrams in FIGS. 1 and 3. This data, received by the microcomputer 24, is used to program the microcomputer 24 to process information from other sensors and to make various fuzing decisions.

The reprogrammable electronic fuze 10 now contains in its microcomputer 24 the data that was transferred from the bubble memory 18, through the sensing circuit 22. This data is used to program the microcomputer 24 to process information received from the munitions physical environmental transducers, or input sensors, and to make various fuzing decisions as an output. The input from the physical environmental transducers (not shown) to the microcomputer 24 and the output from the microcomputer 24 to the munition's mechanisms (not shown) are indicated in FIG. 1 by the input/output sensor electrical conductor 66.

Thus, a reprogrammable electronic fuze 10 has been created to serve the internal operating mechanisms, such as the microcomputer 24; a fuze means that is not destroyed by a change in mission or other aspect for the munition, prior to launch of the munition, but a fuze means which can be readily reprogrammed for a new mission or condition without disassembly of the munition.

As can be readily understood from the foregoing description of the invention, the present structure can be configured in different modes to provide the ability to serve as a reprogrammable electronic fuze means.

Accordingly, modifications and variations to which the invention is susceptible may be practiced without departing from the scope and intent of the appended claims.

What is claimed is:

1. A reprogrammable electronic fuze system, comprising:

a munition, said munition having a wall structure as a component thereof:

an internal fuze circuit means, said internal fuze circuit means being located and positioned within said munition, a portion of said internal fuze circuit means being positioned adjacent to said wall structure;

an external driver circuit means, said external driver circuit means being located on the exterior of said munition in the proximity of said wall structure at which said portion of said internal fuze circuit means is positioned, said external driver circuit means being capable of sending a high frequency electronic signal into said munition to said internal fuze circuit means, said internal fuze circuit means being capable of receiving said high frequency electronic signal to program said internal fuze circuit means, said internal fuze circuit means being further capable of receiving a subsequent high frequency electronic signal from said external driver circuit means to reprogram said internal fuze circuit means without disassembly of said munition to replace any components thereof, said external driver circuit means being separate from said munition and not affixed thereto, which includes;

a first power supply means, said first power supply means having a first terminal and a second terminal;

a current limiting resistor means, said current limiting resistor means being electrically connected to said first terminal of said first power supply means;

an energy storing capacitor means, said energy storing capacitor means being electrically connected to said second terminal of said first power supply means, said first power supply means and said energy storing capacitor means being further connected to a first ground means;

a first switch means, said first switch means being electrically connected to said current limiting resistor means and to said energy storing capacitor means; and a primary transmitting coil means, said primary transmitting coil means being electrically connected to said first switch means, said primary transmitting coil means being capable of sending said high frequency signals to said internal fuze circuit means.

2. A reprogrammable electronic fuze system as recited in claim 1, wherein said internal fuze circuit means consists of:

a write circuit means;

a second switch means, said second switch means being electrically connected to said write circuit means;

a bubble memory means, said bubble memory means being electrically connected to said write circuit means;

a sensing circuit means, said sensing circuit means being electrically connected to said bubble memory means;

a microcomputer means, said microcomputer means being electrically connected to said sensing circuit means; and a second power supply means, said second power supply means being electrically connected to said second switch means, said sensing circuit means, and to said microcomputer means.

3. A reprogrammable electronic fuze system as recited in claim 2, wherein said write circuit means consists of:

a secondary receiving coil means, said secondary receiving coil being located and positioned in close proximity to an interior surface of said wall structure of said munition, said secondary receiving coil means being capable of receiving said high frequency signals from said primary transmitting coil; and a rectifier means, said rectifier means being electrically connected to said secondary receiving coil means, said secondary receiving coil means and said rectifier means being further electrically connected to said second switch means, said electrical connection of said bubble memory means to said write circuit means being an electronic write loop means in said bubble memory means electrically connected to said rectifier means.

4. A reprogrammable electronic fuze means as recited in claim 2, wherein said sensing circuit means consists of:

a differential amplifier means;

a sensing amplifier means, said sensing amplifier means being electrically connected to said differential amplifier means, said electrical connection of said sensing circuit means to said bubble memory means consisting of an electronic read loop means electrically connected to an electronic reference loop means in said bubble memory means electrically connected to said differential amplifier means, said read loop means and said reference loop means being further electrically connected to a second ground means; and a memory read signal means, said memory read signal means being electrically connected to said electronic read loop means through a first bridge element, said memory read signal means being further electrically connected to said electronic reference loop means through a second bridge element.

* * * * *